US006962371B1

(12) United States Patent
Petkovsek

(10) Patent No.: US 6,962,371 B1
(45) Date of Patent: Nov. 8, 2005

(54) INTEGRAL VARIABLY PRINTED SPECIAL SERVICE MAILING ASSEMBLY AND A METHOD FOR USING SAME

(76) Inventor: Glenn Petkovsek, 2 Saverne Cir., Little Rock, AR (US) 72223

( * ) Notice: Subject to any disclaimer, the term of this patent is extended or adjusted under 35 U.S.C. 154(b) by 0 days.

(21) Appl. No.: 09/322,594

(22) Filed: May 28, 1999

Related U.S. Application Data

(63) Continuation-in-part of application No. 08/855,030, filed on May 13, 1997, now Pat. No. 5,951,053, which is a continuation-in-part of application No. 08/425,578, filed on Apr. 20, 1995, now Pat. No. 5,697,648.

(51) Int. Cl.[7] ..... B42D 15/00

(52) U.S. Cl. ..... 283/81; 283/61; 283/116; 283/105; 283/67; 283/70; 283/62; 281/2; 281/5; 462/6; 462/7; 462/8; 462/64; 462/65; 229/300; 229/92.8; 40/638

(58) Field of Search ..... 283/61, 81, 116, 283/62, 67, 70, 105; 281/2, 5; 462/6, 7, 8, 462/64, 65; 229/92.8, 300; 40/638

(56) References Cited

U.S. PATENT DOCUMENTS

| | | | | |
|---|---|---|---|---|
| 4,029,341 A | * | 6/1977 | Neill et al. | 283/21 |
| 4,368,903 A | | 1/1983 | Jones | |
| 4,418,865 A | | 12/1983 | Bowen | |
| 4,492,334 A | | 1/1985 | Dicker | |
| 4,565,317 A | | 1/1986 | Kranz | |
| 4,682,793 A | | 7/1987 | Walz | |
| 5,039,652 A | | 8/1991 | Doll et al. | |
| 5,183,203 A | | 2/1993 | Sanders | |
| 5,190,210 A | | 3/1993 | Walz | |
| 5,267,898 A | | 12/1993 | Doll et al. | |
| 5,397,052 A | | 3/1995 | Walz | |
| 5,476,420 A | | 12/1995 | Manning | |
| 5,501,393 A | | 3/1996 | Walz | |
| 5,507,526 A | | 4/1996 | Petkovsek | |
| 5,524,934 A | * | 6/1996 | Schwan et al. | 283/95 |
| 5,626,370 A | * | 5/1997 | Petkovsek | 283/116 |
| 5,664,725 A | | 9/1997 | Walz | |
| 5,697,648 A | | 12/1997 | Petkovsek | |
| 5,746,450 A | | 5/1998 | Petkovsek | |
| 5,836,622 A | | 11/1998 | Fabel | |
| 5,848,809 A | | 12/1998 | Petkovsek | |
| 5,951,053 A | | 9/1999 | Petkovsek | |
| 5,997,683 A | * | 12/1999 | Popat | 283/105 |
| 6,001,209 A | * | 12/1999 | Popat et al. | 283/105 |
| 6,050,603 A | * | 4/2000 | Petkovsek | 283/61 |

(Continued)

*Primary Examiner*—Derris Banks
*Assistant Examiner*—Mark Henderson
(74) *Attorney, Agent, or Firm*—Patents+TMS, P.C.

(57) ABSTRACT

An assembly for mailing an article requiring delivery by a special service and a method for mailing same are provided. The assembly includes a return postcard and anchor portions removably attached to the return postcard. The anchor portions include adhesive that allows the anchor portions to be attached to a mailpiece. The return postcard includes a special services designator section indicative of the special service required for delivery of the mailpiece. The return postcard is integrally formed, but removably attached, such that the return postcard remains attached to the envelope until received by the addressee, at which time the return postcard may be removed. The assembly is designed to incorporate a form into the return postcard to simplify preparation of the mailpiece for delivery by the special service. Alternatively, the postcard may contain a machine readable code that aids in the delivery and tracking of the mailpiece.

20 Claims, 13 Drawing Sheets

U.S. PATENT DOCUMENTS 6,120,063 A * 9/2000 Petkovsek ..... 283/61
6,213,518 B1 * 4/2001 Raming ..... 283/67
6,290,262 B1 * 9/2001 Petkovsek ..... 283/81
6,371,521 B1 * 4/2002 Petkovsek ..... 283/67
6,560,602 B1 * 5/2003 Carter ..... 707/10
2005/0001021 A1 * 1/2005 Hutchinson ..... 229/300

* cited by examiner

INTEGRAL VARIABLY PRINTED SPECIAL SERVICE MAILING ASSEMBLY AND A METHOD FOR USING SAME

This application is a continuation-in-part of U.S. patent application Ser. No. 08/855,030, filed May 13, 1997 now U.S. Pat. No. 5,951,053 which is a continuation-in-part of U.S. patent application Ser. No. 08/425,578, filed Apr. 20, 1995 now U.S. Pat. No. 5,697,648, issued Dec. 16, 1997.

BACKGROUND OF THE INVENTION

The present invention generally relates to a form for mailing an article requiring delivery by a special service. More specifically, the present invention relates to an integral special service mailing assembly for mailing an article requiring delivery by a special service having a return receipt postcard and a label indicative of the special service and a method for using same.

It is, of course, generally known to mail an article requiring special services for delivery of the article, such as certified mail, registered mail, insured mail, COD, return receipt for merchandise and the like. Known components and methods for assembling a mailer for mailing an article requiring special services have multiple, separate components requiring attachment to an exterior of an envelope for the special services delivery of the article.

For example, when a customer of the U.S. Postal Service desires that an article be mailed by certified mail, for instance, an envelope containing the article is provided to the postal employee by the customer. The postal employee is then required to attach or otherwise provide the envelope with a permanent seal or label indicating that the envelope is to be delivered by certified mail.

Then, a return receipt postcard must be attached to the envelope. The postcard must be completed by the postal employee and/or the customer mailing the envelope containing the article. Some postcards include areas having an adhesive for attaching the postcard to the envelope. Other postcards require separate attachment, by using tape, for example.

Such a procedure is both complex and time-consuming, as well as labor intensive. The procedure requires the postal employee to ensure that all of the appropriate labels and documents are affixed to the envelope prior to delivery of the article. Therefore, the appropriate forms, labels and the like must be adequately stocked and available for the postal employee's use. Further, the postal employee must ensure that all articles are appropriately affixed to the envelope. In addition, the return receipt postcard must be suitably affixed to the envelope so that the return postcard is not removed during the mailing of the article to its destination. Of course, it should be understood that an envelope prepared for special service mailing may be prepared by any individual, not just a postal employee.

A need, therefore, exists for an improved integral special service mailing assembly requiring special services, such as certified mail, insured mail, registered mail, COD, return receipt for merchandise and the like, and a method for using same.

SUMMARY OF THE INVENTION

The present invention provides an assembly and a method for using same for mailing an article requiring delivery by a special service, such as for certified mail, insured mail, register mail, COD, return receipt for merchandise and the like.

In an embodiment of the present invention, a special service mailing assembly is provided. The assembly has a backing sheet. A first mailing form is attached to the backing sheet by an adhesive. The first mailing form includes a first return postcard and a first designator section indicative of a special service wherein the designator section is contained within first exterior sides that define the return postcard. A second mailing form is removably attached to the first mailing form wherein the second mailing form is removably attached to the backing sheet by the adhesive and further wherein the second mailing form includes a second return postcard and a second designator section indicative of the special service contained within second exterior sides that define the second return postcard.

In an embodiment, a first anchor portion extending outside one of the first exterior sides of the first return postcard is provided wherein the first anchor portion has the adhesive on a back side of the first anchor portion.

In an embodiment, a removable label section is provided within the first anchor portion and is removably attached to the first anchor portion.

In an embodiment, the first anchor portion is removably attached to the first return postcard via a tear line.

In an embodiment, a third designator section is contained within the first anchor portion.

In an embodiment, a tear line separates the removable label section within the first anchor portion.

In an embodiment, an area within the designator section has a machine readable code.

In an embodiment, the first designator section is distinctly colored from a remainder of the first return postcard.

In an embodiment, the special services include one of certified mail, registered mail, insured mail, COD, or return receipt for merchandise mail.

In an embodiment, a second anchor portion is attached to the first return postcard outside one of the exterior sides of the return postcard wherein a backside of the second anchor portion includes the adhesive.

In an embodiment, a tear line separates the second anchor portion from a remainder of the first return postcard.

In an embodiment, a tear line separates the first mailing form from the second mailing form.

In another embodiment of the present invention, a method is provided for preparing a mailpiece for delivery by a special service. The method comprises the steps of: providing a backing sheet; providing a first mailing form including a first return postcard to the backing sheet wherein the first return postcard has a special service designation section within exterior sides that define the postcard; providing an area within the return postcard wherein variable information is printed; providing a second mailing form including a second return postcard removably attached to the backing sheet wherein the second return postcard has a second special designation section within exterior sides that define the second return postcard; printing information relating to the special service delivery of the mailpiece on the area within the return postcard; removing the first mailing form from the backing sheet; and attaching the first mailing form to the mailpiece to effect delivery by the special service.

In an embodiment, the method includes the step of providing an anchor portion adjacent the first return postcard.

In an embodiment, the method includes the step of providing a removable label section as a portion of the anchor portion and removing the removable label section from the anchor portion.

In another embodiment of the present invention, a mailing assembly is provided for preparing a mailpiece for delivery by a special service. A first mailing form has a first return postcard and a first anchor portion removably attached to the first return postcard wherein the first anchor portion has an adhesive on a backside of the first anchor portion, and further the first return postcard has no adhesive. A first backing strip is received over the adhesive on the backside of the first anchor portion. A second mailing form has a second return postcard and a second anchor portion is removably attached to the second return postcard wherein the second anchor portion has the adhesive on a backside of the second anchor portion. The second return postcard has no adhesive. A second backing strip is received over the adhesive on the backside of the second anchor portion. A first designator section indicative of a special service is contained within exterior sides of the first return postcard.

In an embodiment, a tear line is arranged for separating the first return postcard from the first anchor portion.

In an embodiment, a tear line is arranged for separating the first mailing form from the second mailing form.

In an embodiment, a tear line is arranged for separating the second anchor portion from the second return postcard.

In an embodiment, the area contained within the first return postcard is variably printed with a machine readable code.

It is, therefore, an advantage of the present invention to provide an improved assembly for mailing an article requiring delivery by a special service.

Another advantage of the present invention is to provide a simplified method for mailing an article requiring special services.

And, another advantage of the present invention is to provide an assembly that is integrally formed as a complete unit for mailing and labeling of an article requiring special services.

Yet another advantage of the present invention is to provide an assembly and a method for mailing an article requiring special services without requiring additional adhesives or fixatives for attaching the same to the mailpiece.

Moreover, an advantage of the present invention is to provide an assembly and a method for mailing an article requiring special services that is substantially foolproof.

Yet, a further advantage of the present invention is to provide an assembly which works on automated printing equipment.

And, another advantage of the present invention is to provide an assembly including a label and a form that provides for pre-imaging or pre-printing of variable information thereon.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides an integral special service mailing assembly for mailing an article requiring delivery by a special service. Further, the present invention provides a method for using the assembly for mailing articles requiring delivery by a special service.

Figure 1:
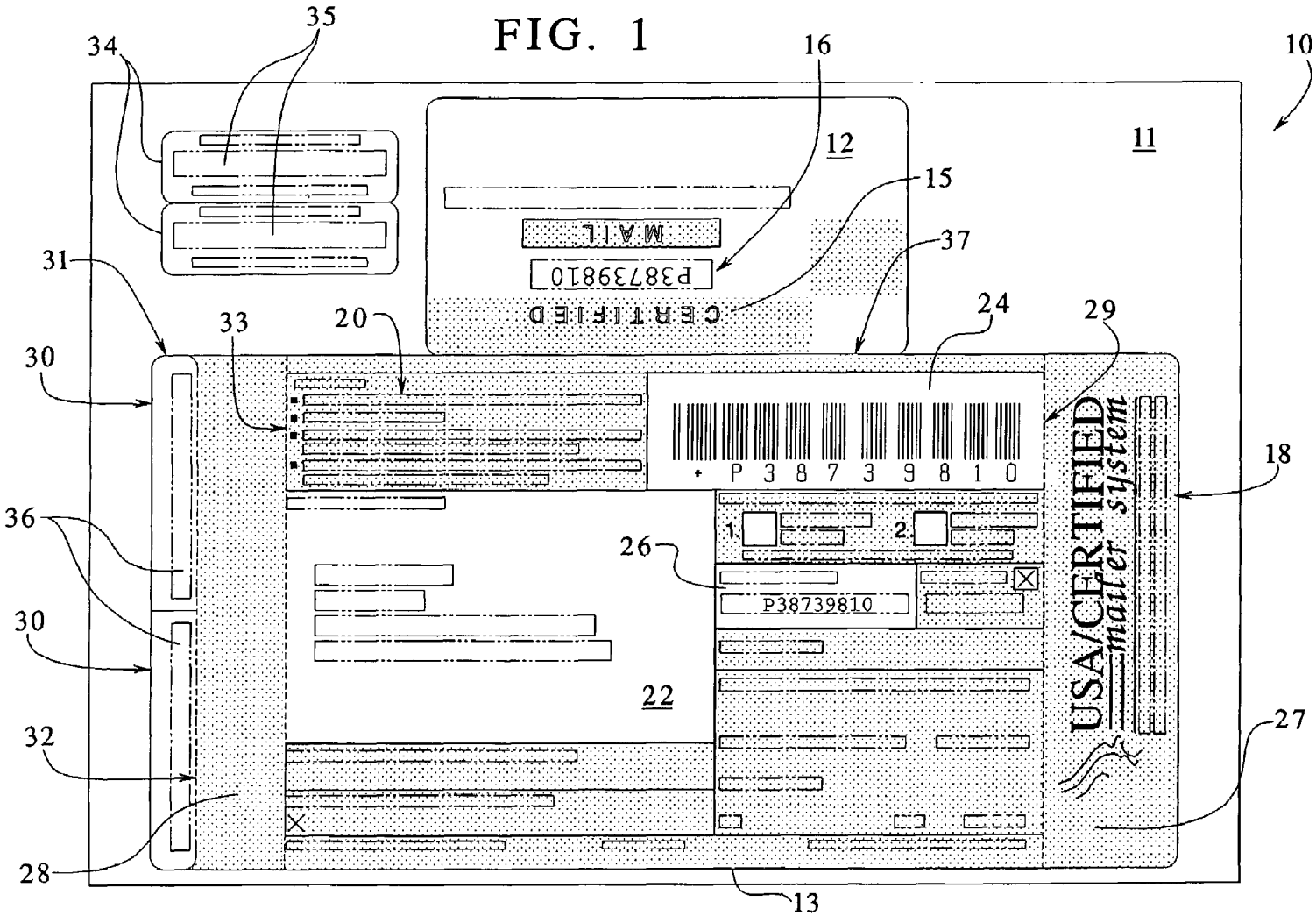
FIG. 1 illustrates a plan view of a front side of an embodiment of an assembly of the present invention.
Figure 4:
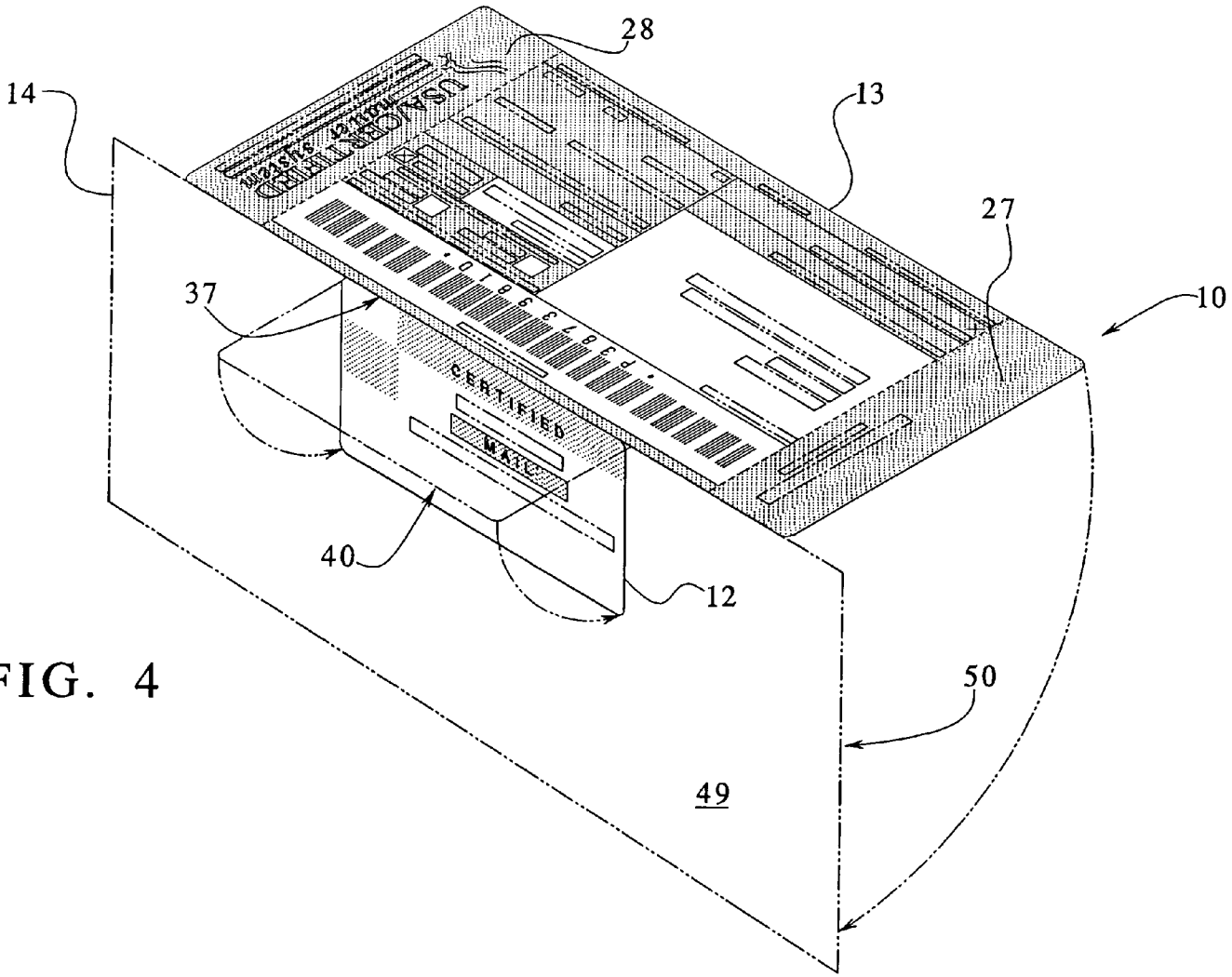
FIG. 4 illustrates a perspective view of a front side of an embodiment of the assembly of the present invention with an article to be mailed using the same.

Referring now to the drawings, wherein like numerals refer to like parts, FIG. 1 is a front plan view that generally illustrates an embodiment of an assembly 10 formed from a single sheet 11 to provide both a label 12 and a return postcard 13. The assembly 10 is capable for use in mailing an article 14 requiring a special service as shown in FIG. 4. Although a certified mail envelope is illustrated, it should be understood that the present invention is applicable to any mailing item requiring special services, such as insured mail, registered mail, COD, return receipt for merchandise and the like.

The front side of the embodiment of the assembly 10 illustrated in FIG. 1 includes the label 12. The label 12 is, in a preferred embodiment, a pre-printed label indicative of the special service required for mailing of the article 14. The label 12 is preferably pre-printed directly on the sheet 11. The pre-printed label 12 includes a special service indicator 15 and a window section 16 in which an article identification number can be printed.

Figure 9:
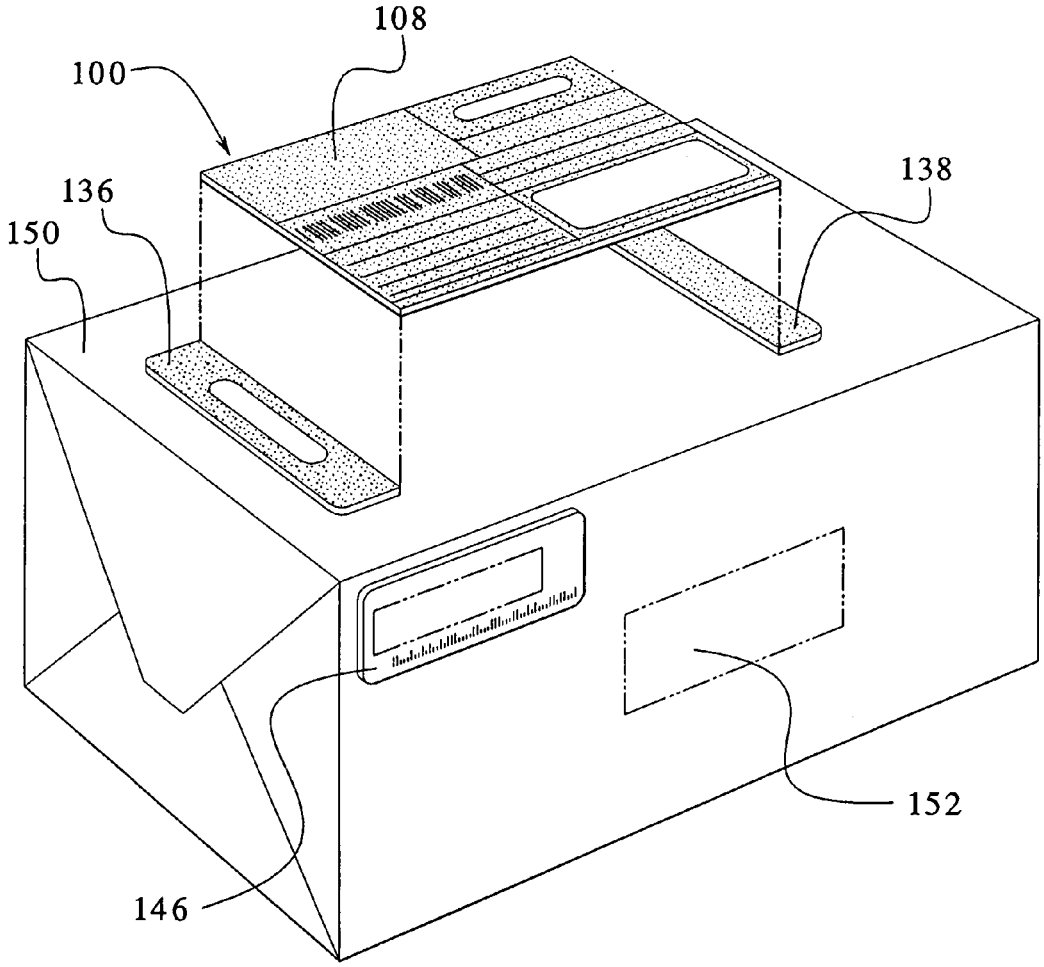
FIG. 9 illustrates a perspective view of an embodiment of the assembly as used on a package.
Figures 10, 11, 12:
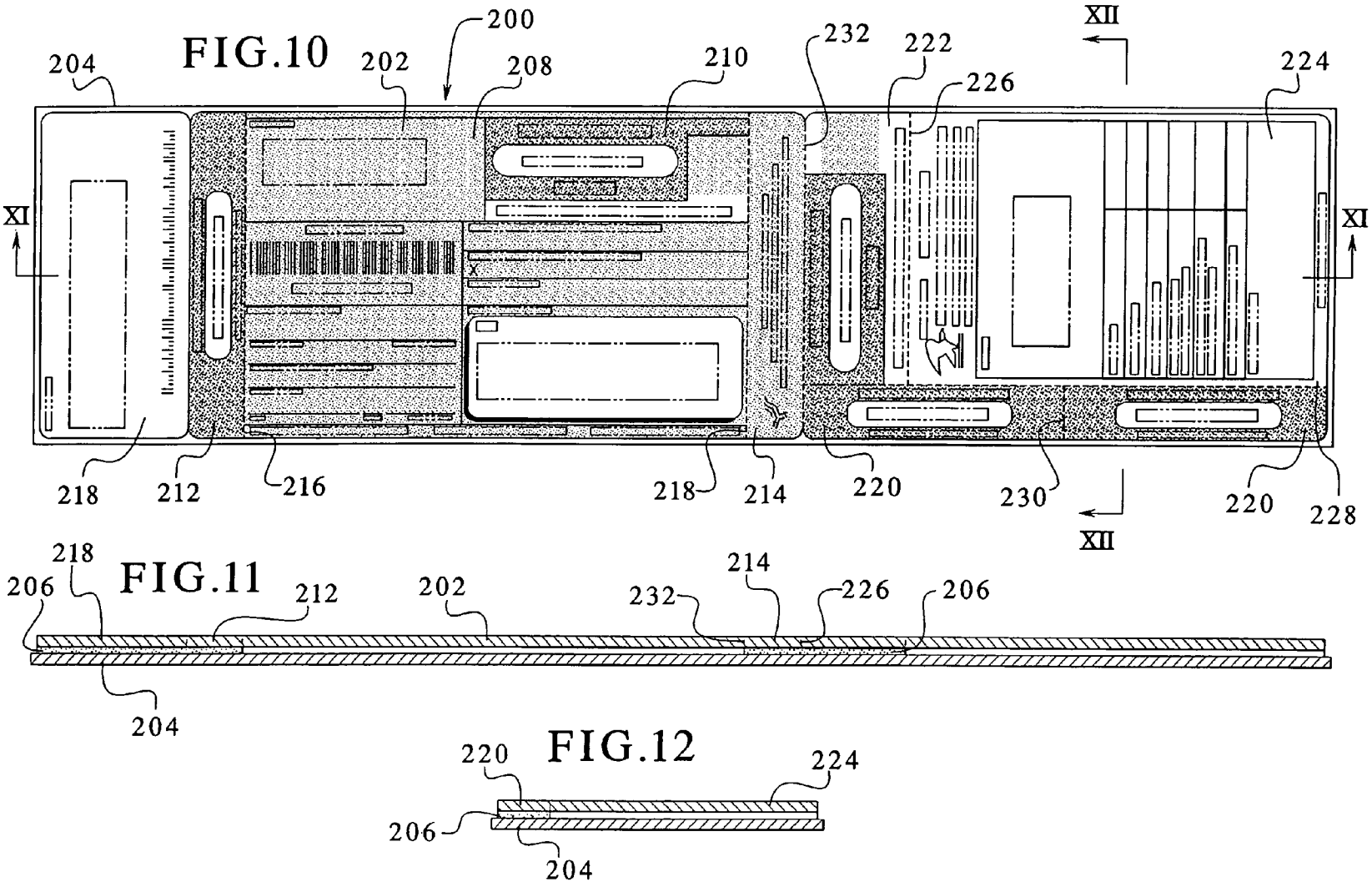
FIG. 10 illustrates a plan view of a front side of yet another embodiment of an assembly of the present invention.
FIG. 11 illustrates a cross-sectional view taken generally along the line XI—XI of FIG. 10.
FIG. 12 illustrates a cross-sectional view taken generally along the line XII—XII of FIG. 10.

Referring now to FIGS. 10–12, an alternate embodiment of a mailing assembly 200 is generally illustrated. The assembly 200 incorporates a first layer 202 and a second layer 204 with an adhesive 206 in selected areas there between as generally illustrated in FIGS. 11 and 12. The first layer 202 of the mailing assembly 200 includes a return postcard 208 with an incorporated designator section 210. At each end of the return postcard 208 are anchor portions 212,214 separable by perforated tear lines 216,217, respectively. On a back side of each of the anchor portions 212,214 is the adhesive 206. The adhesive 206 provides for attachment of the first layer 202 to the second layer 204 and following removal of the first layer 202 from the second layer 204, the adhesive 206 beneath the anchor portions 212,214 allows for attachment of the first layer 202 to a mailpiece. An auxiliary label 218 is provided exterior to the anchor portion 212 and has the adhesive 206 on its back side. As a result, the auxiliary label 218 may be implemented as described with references to FIGS. 7–9.

In addition, the return receipt postcard 13 has a number of sub-sections requiring completion by the sender prior to mailing. One sub-section illustrated at numeral 26 includes a machine readable article identification number corresponding to the number in the window section 16 of the pre-printed label 12. The sub-section 26 may have a background color that contrasts with the color of the return receipt postcard 13 so as to simplify the reading of the machine-readable code in the sub-section 26. Other sections, as well, may include similar color-contrasting portions within the return receipt postcard 13.

Another section of the bottom portion 18 of the assembly 10 is, in a preferred embodiment, a first anchor portion 27 at one end of the return receipt postcard 13 and a second anchor portion 28 at the opposite end. The first anchor portion 27 is separable from the return receipt postcard 13 by means of a perforated tear line 29.

The second anchor portion 28 includes at least one article tracking label 30 provided along a detachable strip 31 at the opposite end of the bottom portion 18 of the assembly 10 and is removable from the bottom portion 18 by a perforated tear line 32. The second anchor portion 28 is also separable from the return receipt postcard 13 by tearing along a perforated tear line 33.

The article tracking label 30 may be adhesively backed for subsequent attachment to a receipt or other item requiring designation of the article number for related purposes. As illustrated, two tracking labels 30 are provided in the embodiment shown. For example, one of the tracking labels 30 may be used by a postal delivery employee on a postal form PS 3849, a delivery notice, (not shown). The second tracking label 30 may be used for the receiver's record use.

In addition, in the embodiment shown, two additional tracking labels 34 are provided. The two additional tracking labels 34, which also include a section 35 for the article identification number, may be used for the sender's records.

The certified article number tracking labels 30 can also be used for the sender's and receiver's record keeping and/or accounting use. Each tracking label 30 has the section 33 for the article identification number. The tracking label 30 may be provided with adhesive on its reverse side. The tracking label 30 may also be a peel and stick type label.

Thus, the bottom portion 18 of the assembly 10 includes three main sections: the return receipt postcard 13 and the first and second anchor portions 27, 28. In addition, the tracking labels 30, 34 are provided. The label 12 is separated from the return receipt postcard 13 by a score line 37 to facilitate separation of the postcard 13 upon delivery of the article 14. As mentioned above, the return receipt postcard 13 has a number of sub-sections requiring completion by the sender prior to mailing the article 14. After delivery of the article 14, the return receipt postcard 13 is detachable from the first and second anchor portions 27, 28 by tearing along the perforated tear lines 29, 33 respectively.

An advantage of the present invention is that a number of the sub-sections of the return postcard 13 and the label 12 discussed above can be pre-printed when the assembly 10 of the present invention is used.

Figure 2:
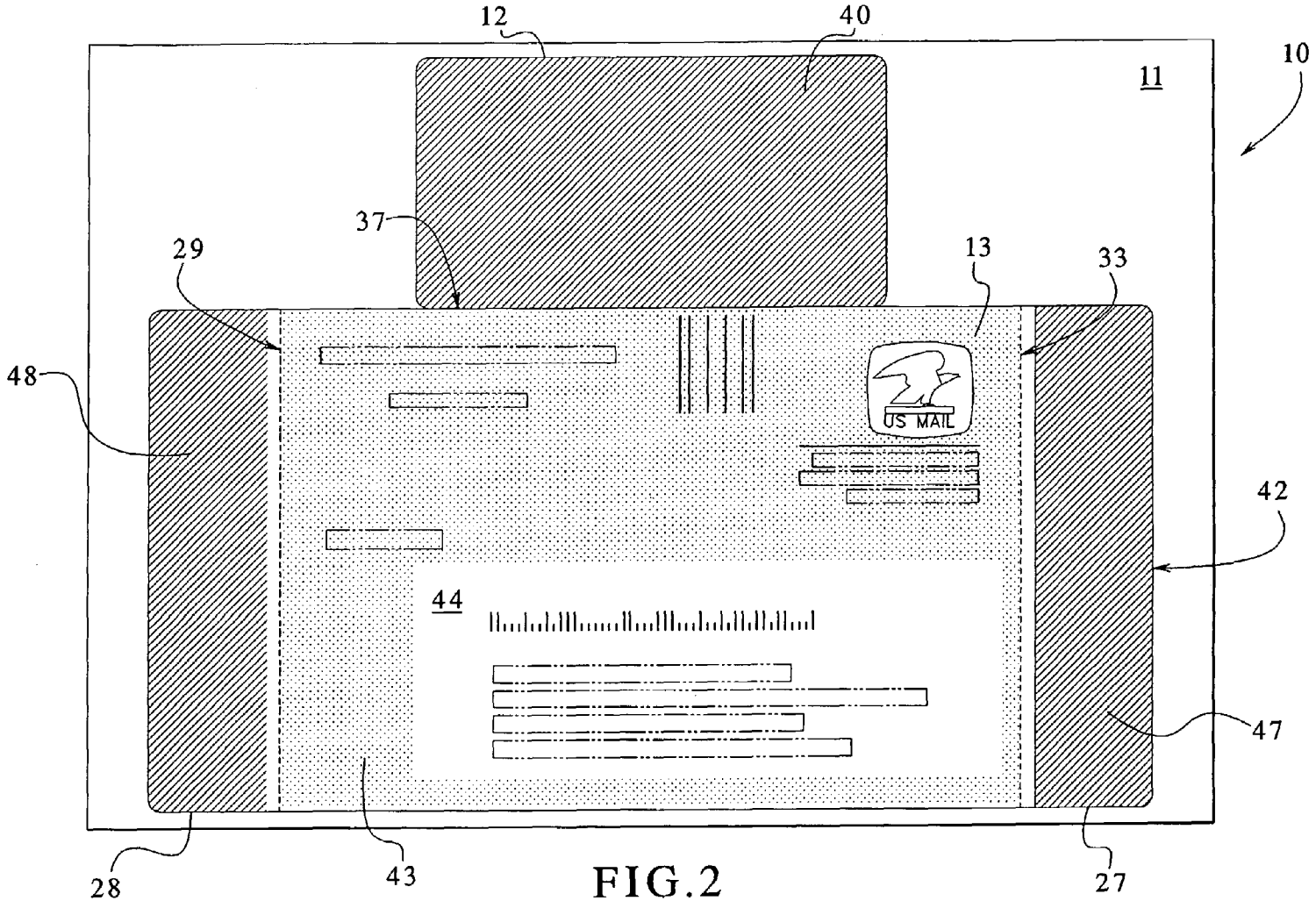
FIG. 2 illustrates a plan view of a back side of an embodiment of the assembly of the present invention.

Referring now to FIG. 2, a back plan view of an embodiment of the assembly 10 is illustrated. The reverse side of the label 12 shown in FIG. 1 has an adhesive portion 40. The adhesive portion 40 may be a peel and stick type adhesive and is provided to seal the label 12 to the article 14 requiring special service mailing as shown in FIG. 4.

A back bottom portion 42 of the assembly 10 includes a front side 43 of the return receipt postcard 13. The return receipt postcard 13 includes a "Return To" section 44. The "Return To" section 44 may be color-contrasted with the remainder of the return receipt postcard 13 to enable simplified reading of the "Return To" section 44.

The score line 37 is provided along the top side of the return receipt postcard 13. For subsequent detachment of the return receipt postcard 13, the perforated tear lines 29, 33 are provided along the edges adjacent to the anchor portions 27, 28. The first anchor portion 27 has a first adhesive portion 47 and the second anchor portion 28 has a second adhesive portion 48 to adhere the back bottom portion 42 to the article 14 prior to mailing.

Figure 3:
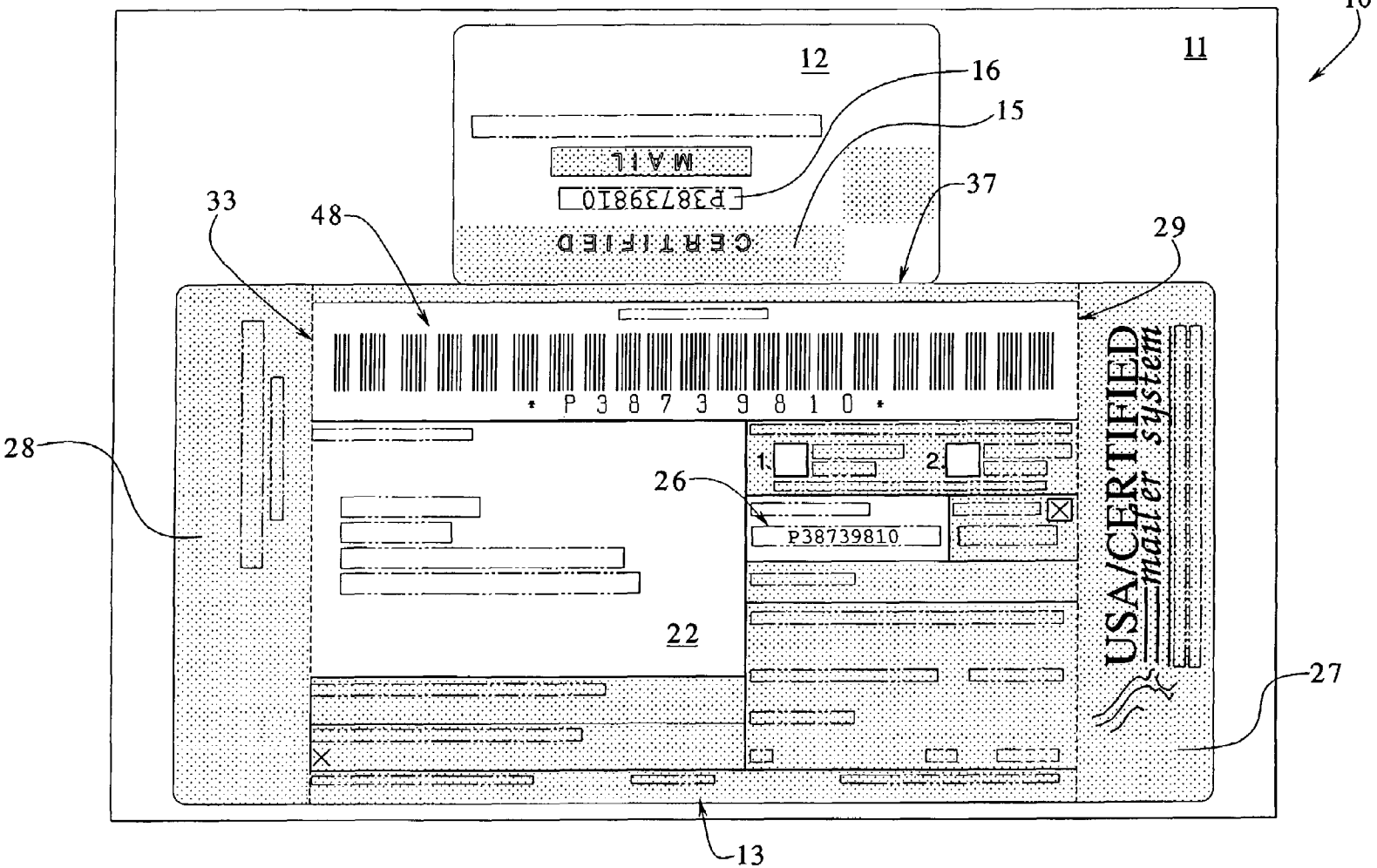
FIG. 3 illustrates a plan view of a front side of another embodiment of the assembly of the present invention.

FIG. 3 shows another embodiment of the assembly 10 of the present invention, wherein like numerals represent like parts. This embodiment is a simplified version of the prior embodiment in that it does not have the instruction section 20 nor does it have the tracking labels 30, 34. However, the embodiment illustrated in FIG. 3 as an enlarged bar code region 48 for easier reading during high speed processing. The embodiment of the present invention illustrated in FIG. 3 is shown in use in FIG. 4.

Referring now to FIG. 4, the article 14 requiring special service, shown from its front side, is shown. The pre-printed label 12 is shown having the window section 16 in which the certified mail number is printed either manually or automatically. As illustrated, the label 12 folds down onto a front side 49 of the article 14 requiring special service mailing. The label 12 is adhered to the front side 49 of the article 14 by means of the adhesive portion 40 located on the back side of the label 12 (see FIG. 2). Also as illustrated in FIG. 4, the bottom portion 18 of the assembly 10, including the anchor portions 27, 28 and the return receipt postcard 13, is sealed to a back side 50 of the article 14 and the anchor portions 27, 28 are sealed to the article 14 by the adhesive portions 47 and 48, respectively. Also, the score line 37 is located at the top of the article 14 to provide for easier subsequent separation of the return receipt postcard 13 from the anchor portions 27, 28 and the label 12 upon delivery of the article 14.

Figure 5:
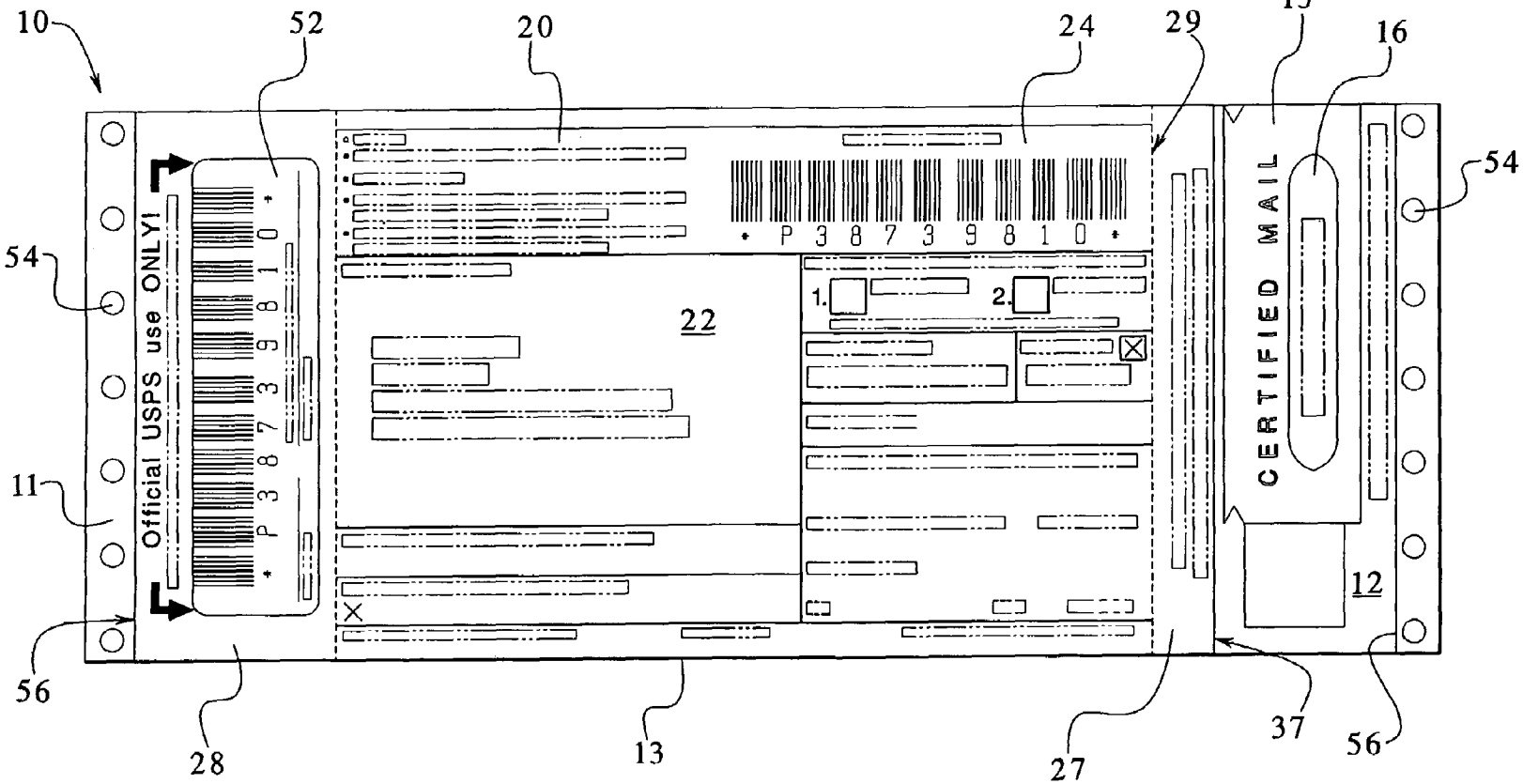
FIG. 5 illustrates a plan view of a front side of another embodiment of the assembly of the present invention.
Figure 6:
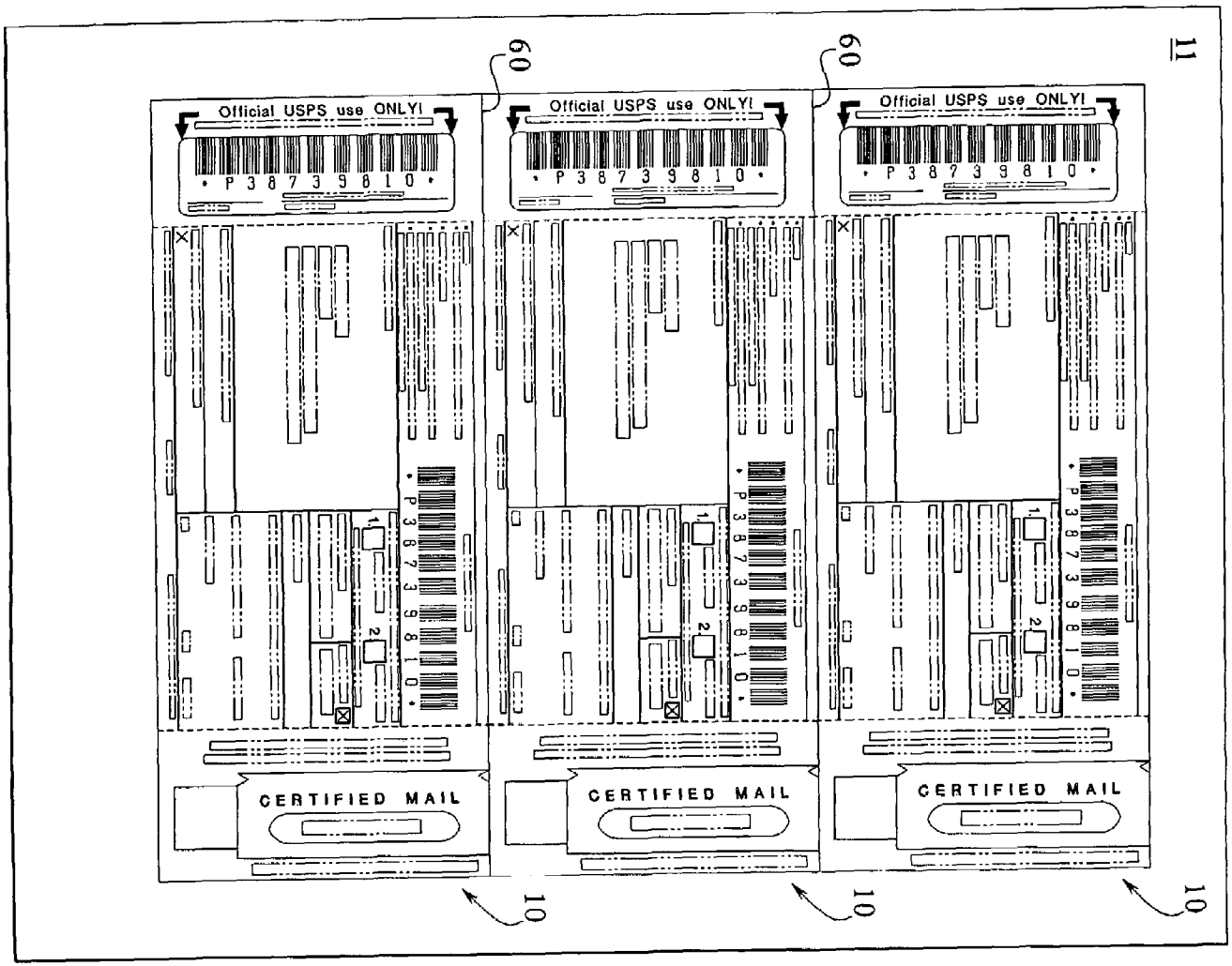
FIG. 6 illustrates another embodiment of the assembly of the present invention in which a plurality of assemblies are located on a single sheet.

FIG. 5 illustrates another embodiment of the assembly 10 of the present invention. In the embodiment shown in FIG. 5, the orientation of the label 12 with respect to the postcard 13 is changed. However, like numerals represent like parts and the score line 37 between the label 12 and the postcard 13 is shown located between the label 12 and the return receipt postcard 13. In addition, a tracking indicator 52 is provided on the second anchor portion 28. Another variation in the embodiment shown in FIG. 5 is that the sheet 11 has a plurality of tracker holes on the edges thereof for use in a printer having tracking wheels to advance the paper. The tracking holes 54 are located on a tracking strip 56. In addition, a plurality of the assembly 10 can be provided on a single sheet 11 as shown in FIG. 6. Each assembly 10 is separable from the adjacent assembly 10. This can be accomplished by a score line 60. In such a case, it would be preferred that the assembly 10 be a peel and stick type assembly that is removably attached to the sheet 11. Thus each individual assembly 10 could be detached from the sheet 11 as needed. Also the entire sheet could be printed at one time for subsequent separation and application to separate articles 14.

The assembly 10 can be printed using any known method of printing and is not limited to any single type. Such printing methods include, but are not limited to, laser printing, thermal printing, dot matrix printing and the like. Printing may be performed on continuously fed forms or on individually fed forms.

Figure 7:
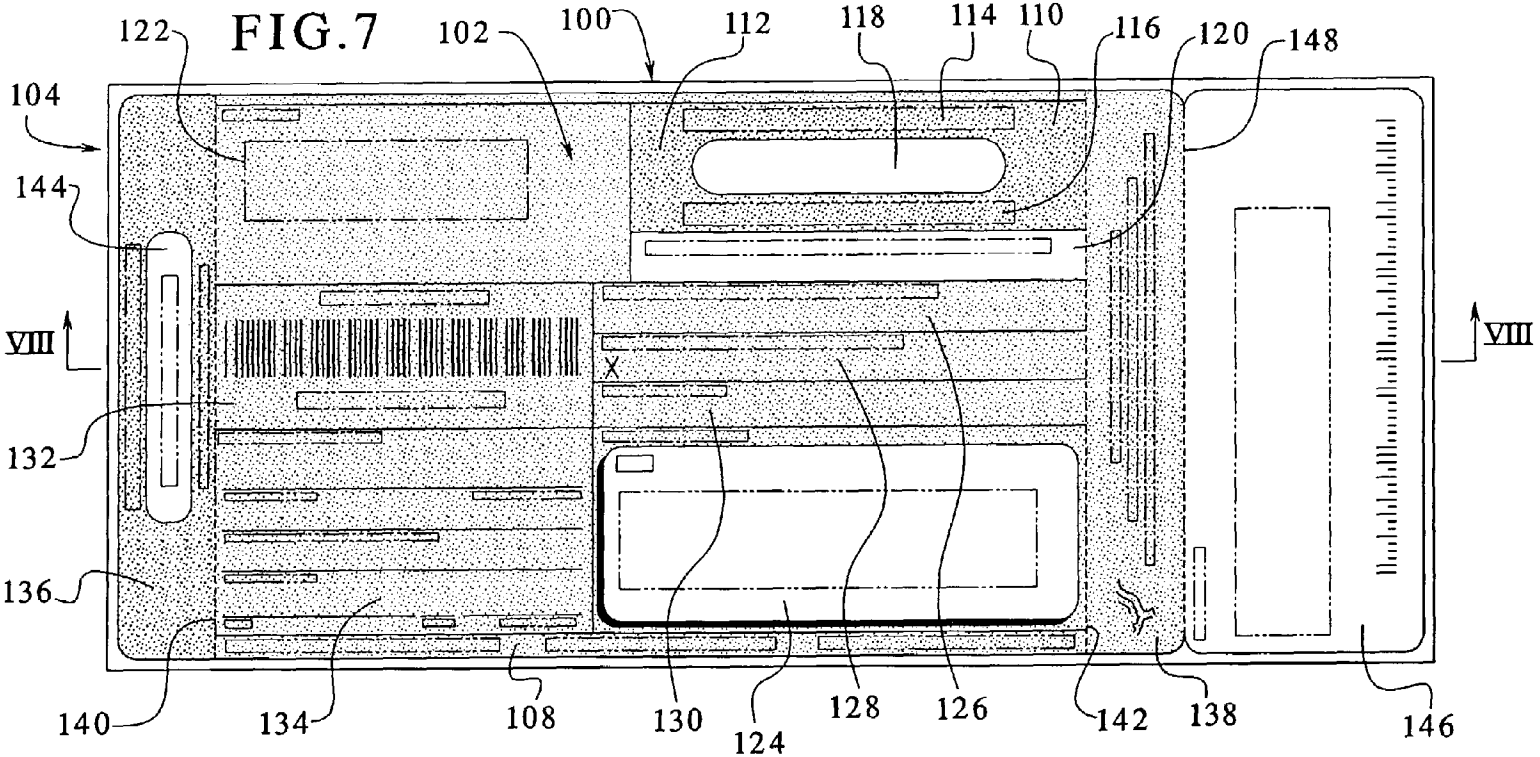
FIG. 7 illustrates a plan view of a front side of another embodiment of an assembly of the present invention.
Figure 8:
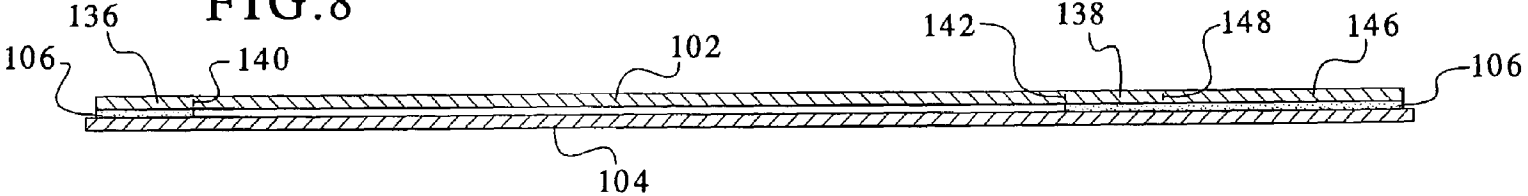
FIG. 8 illustrates a cross-sectional view taken generally along the line VIII—VIII of FIG. 7.

Referring now to FIGS. 7–9, an alternate embodiment of a mailing assembly 100 is illustrated. The mailing assembly 100 includes a first layer 102 and a second layer 104. The first layer 102 and the second layer 104 are separably attached via an adhesive 106 between selected portions of the two layers 102,104. The first layer 102 includes a plurality of separable parts including a return postcard 108 having an integrally formed designator section 110. The return postcard conforms with requirements for, for example, United States Postal Service Form 3811. The designator section 110 includes information necessary to comply with requirements for, for example, United States Postal Service Forms 3804, 3806, 3813, 3856 or the like. The designator section 110 heretofore has been implemented as a separate and distinct form apart from the return postcard 108. The unique arrangement of the return postcard 108 with the designator section 110 allows for incorporation of what previously required completion of two forms and subsequent attachment of two forms to, for example, a package to be delivered requiring special services for delivery thereof. As a result, use of the mailing assembly 100 of the present invention substantially simplifies and expedites the preparation of such a mailpiece requiring delivery by a special service, such as certified mail, return receipt for merchandise, insured mail, registered mail, and the like.

The designator section 110 includes a first area 112 that is distinctly colored from a remainder of the area. For example, the color of the first area 112 may be green to designate the generally recognized color for certified mail or may be brown to designate the generally recognized color for return receipt for merchandise, or the like. Within the first area 112, wording areas 114,116 may be provided to specifically denote the type of special service for which the mailing assembly is to be implemented. An article identifying number area 118 is provided within the designator section 110 to provide, preferably, a machine readable number associated with the mailpiece. This is particularly useful for tracking of the mailpiece before, during and after delivery by the special service.

A special instruction area 120 is also incorporated within the designator section 110. Both the article identifying number area 118 and the special instruction area 120 have a distinctly colored background to improve the machine readability of the information within these areas. The special instruction area 120 may include, for example, specific instructions such as "RESTRICTED DELIVERY", "ADDRESSEE'S ADDRESS REQUESTED", "RETURN RECEIPT REQUESTED" or the like. The return postcard 108 includes other information generally required within specific sections, such as sender information area 122, article addressee area 124, recipient name area 126, recipient signature area 128, date received area 130, machine readable document control area 132, and addressee address area 134.

On each side of the return postcard 128 are anchor portions 136,138. The anchor portions 136,138 are separable from the return postcard 128 by perforated tear lines 140, 142, respectively. The anchor portions 136,138 may also be printed with variable information or pre-printed information relating to the mail handling or information of a general nature. As shown in the anchor portion 136, an article identifying number area 144 is provided that may include a machine readable article identifying number related to the special delivery of the mailpiece for which the mailing assembly is used. The article identifying number area 144 may be implemented as a removable label from within the anchor portion 136 separable therefrom by die-cut lines, score lines, or the like. The anchor portions 136,138 are removably secured to the second layer 104 via the adhesive 106.

As further illustrated, an auxiliary label 146 may be provided and implemented in a number of fashions. For example, the auxiliary label 146 may act as a mailing label, a return address label, or the like. The auxiliary label 146 may be separable from a remainder of the mailing assembly 100 via a score line 148. Alternatively, the score line 148 may be implemented as a perforated tear line, die-cut lines or the like. As a result, the auxiliary label 146 is separable from the remainder of the mailing assembly 100 as well as from the second layer 104 with an adhesive back side for attachment to, for example, a mailpiece.

As illustrated in FIG. 9, the mailing assembly 100 is attached to a mailpiece 150 by removing the mail assembly 100 from the second layer 104 and attachment of the anchor portions 136,138 using the adhesive 106 on a back side of the anchor portions 136,138 for attachment to the mailpiece 150. The return postcard 108 is separable from the anchor portions 136,138 following delivery of the mailpiece 150 to, for example, confirm receipt of delivery of the mailpiece 150. As illustrated, the auxiliary label 146 is incorporated as a return address label. Alternatively, the auxiliary label 146 may be used as an addressee's label and incorporated in the area generally designated at 152 in FIG. 9.

The assembly 10 also has a front bottom portion 18 that includes the return receipt postcard 13 that can be similar to United States Postal Service form PS-3811. The return receipt postcard 13 may include a set of instructions 20 for the sender, as well as an article addressee section 22 for pre-printing the addressee's address. The return receipt postcard 13 also has a document control number bar code 24 to aid in tracking of the article 14.

The mailing assembly 200 also includes additional article identifying number areas 220 with the adhesive 206 on its back side for removable attachment from the second layer 204 and subsequent attachment of the article identifying number area 220 to a specific item as necessary. In addition, the mailing assembly 220 may further include an additional designator section 222 that substantially repeats the information in the designator section 210 for additional usage on the mailpiece on which the mailing assembly 200 is implemented.

Further, the mailing assembly 200 may include a receipt section 224. The receipt section 224 is a receipt for the sender of the mailpiece. The receipt section 224 generally includes information corresponding to, for example, United States Postal Service Form 3800. The receipt 224 is detachable from a remainder of a mailing assembly 200 via perforated tear lines 226,228. The perforated tear line 228 is also implemented to remove the article identifying number areas 220 from a remainder of the mailing assembly 200 and is separately detachable one from the other via the perforated tear line 230. In addition, the auxiliary designator section 222 may also be separable from a remainder of the assembly 200, namely the anchor portion 214, via the perforated tear line 232. The embodiment illustrated in FIG. 10 may be implemented similarly to the invention shown and described with reference to FIGS. 7–9. The return receipt 224 is typically removed for use by the sender as verification that the special service was requested and the amount paid for that special service.

Either of the mailing assemblies 100,200 may be incorporated in a series of forms continuously repeated. Therefore, the mailing assemblies 100 or 200 may be linked together such that they are incorporated as a continuous series of forms or, alternatively, a roll of forms, or the like.

The second layer 104 or 204 of the mailing assemblies 100 or 200, respectively, may include an area that is die-cut with a frozen label such that if duplex printing is implemented and variable information is simultaneously or subsequently printed on a back side of the return postcard, for example, then that information remains on the back side of the return postcard following removal of the second layer from a remainder of the mailing assembly 100,200.

Figure 13:
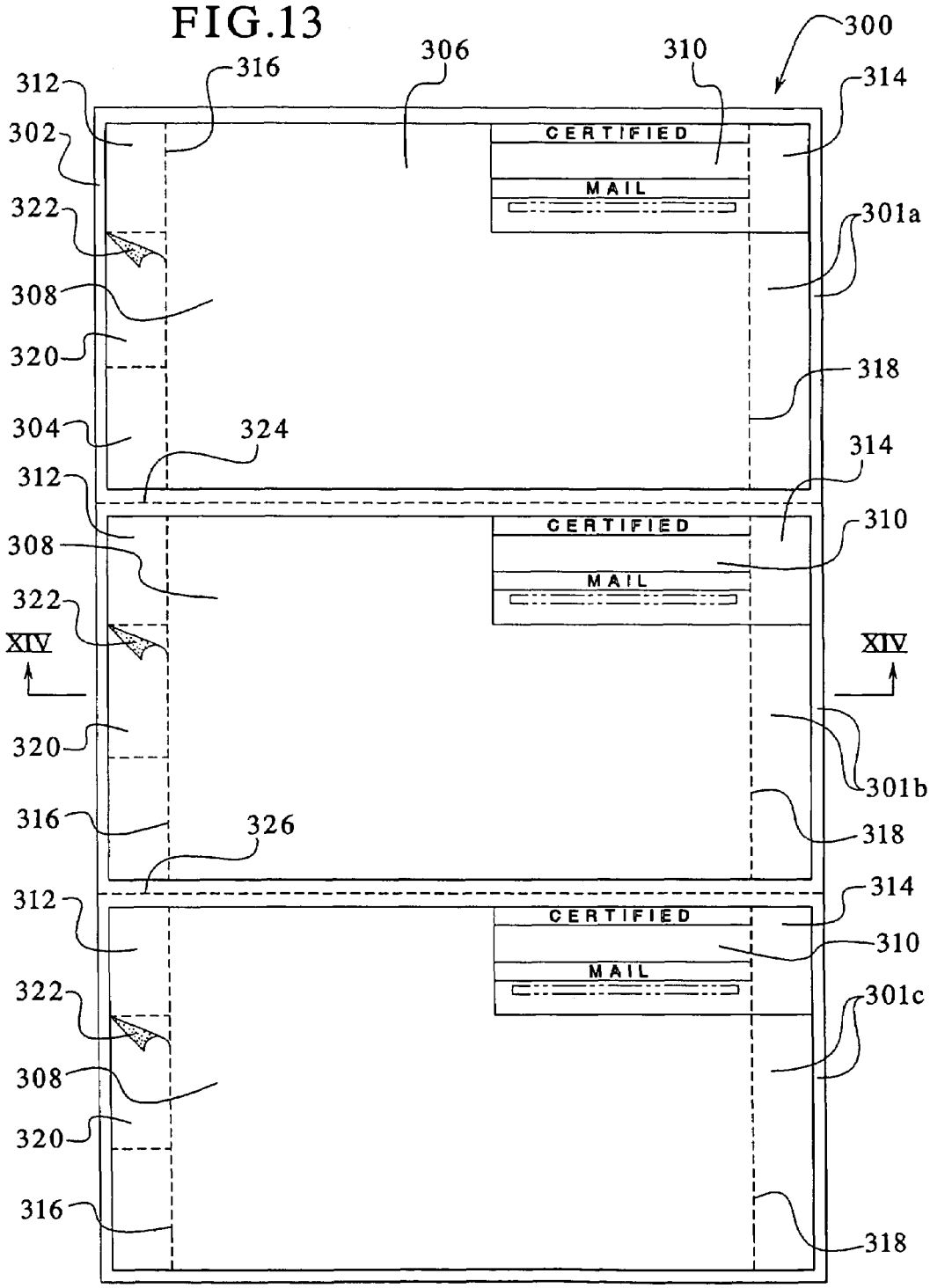
FIG. 13 illustrates a plan view of an assembly of yet another embodiment of the present invention in which a plurality of forms are arranged on a single sheet.

Referring now to FIG. 13, an alternate embodiment of a mailing assembly 300 is illustrated. The mailing assembly 300 includes three mailing forms 301*a*, 301*b* and 301*c*. The mailing form 301*a* is detachably connected to mailing form 301*b* via tear line 324. The mailing form 301*b* is detachable connected to mailing form 301*c* via tear line 326. Each of the mailing forms 301*a*, 301*b* and 301*c* is preferably constructed from a layer 304 received over a backing sheet 302. The layer 304 includes a return postcard 306 having a blank printable area 308.

The area 308 may be printed upon using any conventional printing method including impact printing, ink jet printing, laser printing, dot matrix printing or the like. The printing method may add variable information to the return postcard 306. For example, the printing method may add information similar to U.S. Postal Service Form 3811. Information printed upon the return postcard may be modified to include information, content or form as desired by the assembly user.

The return postcard 306 includes a special services designator section 310 integrally formed as a part of and within the exterior border of the return postcard 306. The designator section 310 includes information necessary to comply with requirements for, for example, U.S. Postal Service Forms 3804, 3806, 3813, 3856 and the like. The designator section 310 may be distinctly colored from a remainder of the return postcard 306. For example, the color may be green to designate the generally recognized color for certified mail or may be brown to designate the generally recognized color for return receipt for merchandise mail.

On each side of the return postcard 306 are anchor portions 312,314. The anchor portions 312,314 may be separable from the return postcard 306 by perforated tear lines 316,318, respectively, or other similar tear lines may be implemented. The anchor portions 312,314 may also be printed with variable information relating to the mail handling or information of a general nature.

Additionally, the anchor portion 314 may include a taggant area (not shown). The taggant area is a special area that fluoresces under long-wave ultraviolet light for detection by a suitably placed detector of the presence of a mailpiece requiring delivery by one or more special services.

The anchor portion 312 may include a removable label section 320. The removable label section 320 may be separable from the anchor portion 312 by die cut lines, score lines or the like. The adhesive 322 may extend under anchor portions 312,314 to removably attach the anchor portions 312,314 to the backing sheet 302. The adhesive 322 may also extend under the removable label section 320. Upon removal of the label section 320 from a remainder of the anchor portion 312, the label section 320 may be attached to the mailpiece requiring delivery by a special service. The return postcard 306 is free of adhesive.

Figure 14:
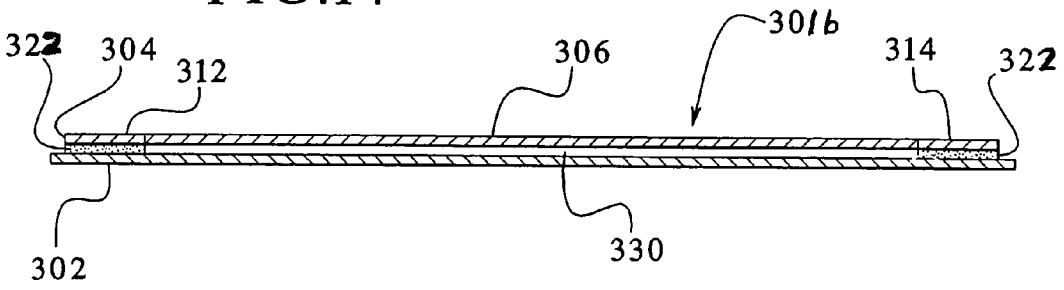
FIG. 14 illustrates a cross-sectional view taken along line XIV—XIV of FIG. 13.

Referring now to FIG. 14, a cross-sectional view of the mailing form 301*b* is illustrated. The mailing form 301*b* includes the backing sheet 302 and the layer 304. The layer 304 is removably attached to the backing layer 302 via an adhesive layer 322 under the anchor portions 312,314. An area 330 is free of adhesive and is provided under the return postcard 306.

Figure 15:
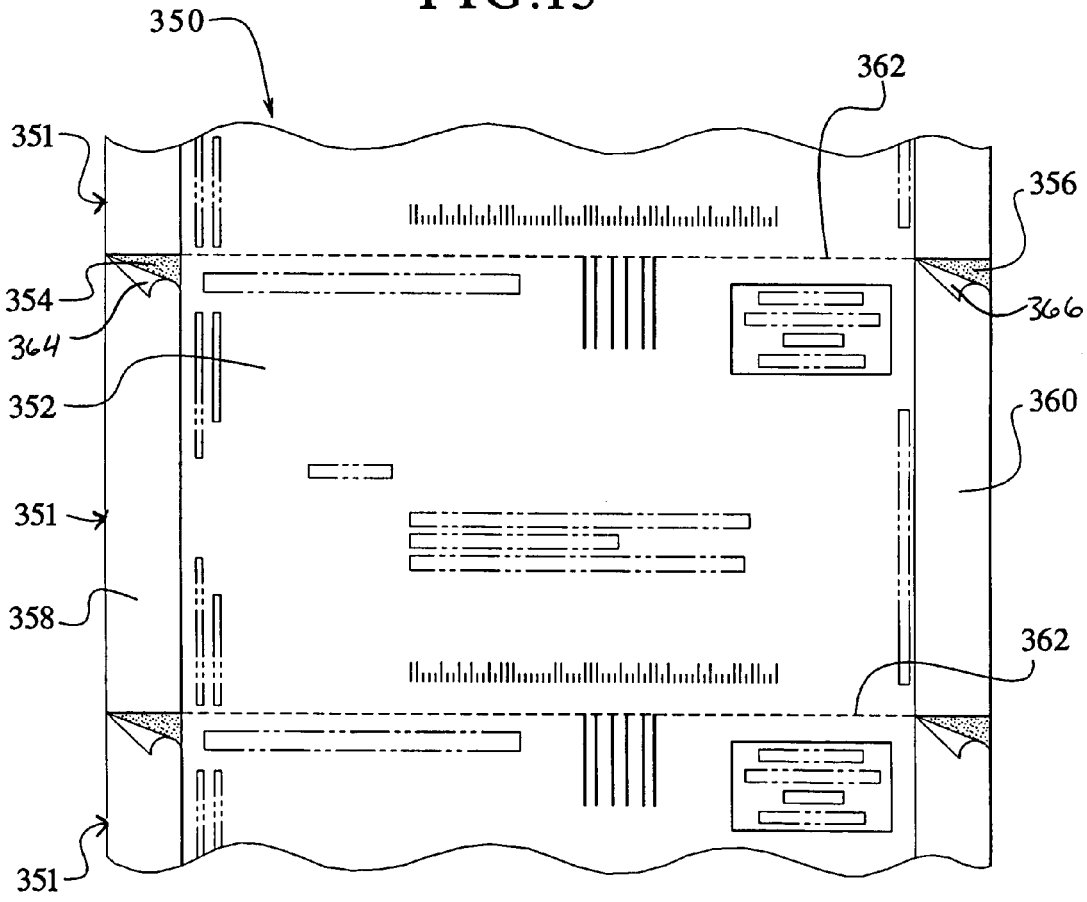
FIG. 15 illustrates a partial plan view of a back side of another embodiment of an assembly of the present invention in which a plurality of forms are located on a continuous roll.

Referring now to FIG. 15, a back side of an alternate embodiment of a mailing assembly 350 is illustrated. The mailing assembly 350 has a plurality of mailing forms 351 that are removably connected to each other via tear lines 362. The mailing assembly 350 includes a return postcard 352 that may contain information related to the delivery of the postcard 352. The mailing assembly 350 includes adhesive portions 354,356 contained on anchor portions 358,360. Backing strips 364,366 are removably attached to the adhesive portions 354,356. In use, the backing strips 364,366 are removed, leaving the adhesive portions 354,356 on the anchor portions 358,360. The mailing form 351 is then attached to a mailpiece for delivery by a special service. The mailing assembly 350 may form a continuous roll of the mailing form 351 wherein a plurality of the mailing forms 351 may be connected in end-to-end fashion.

Figure 16:
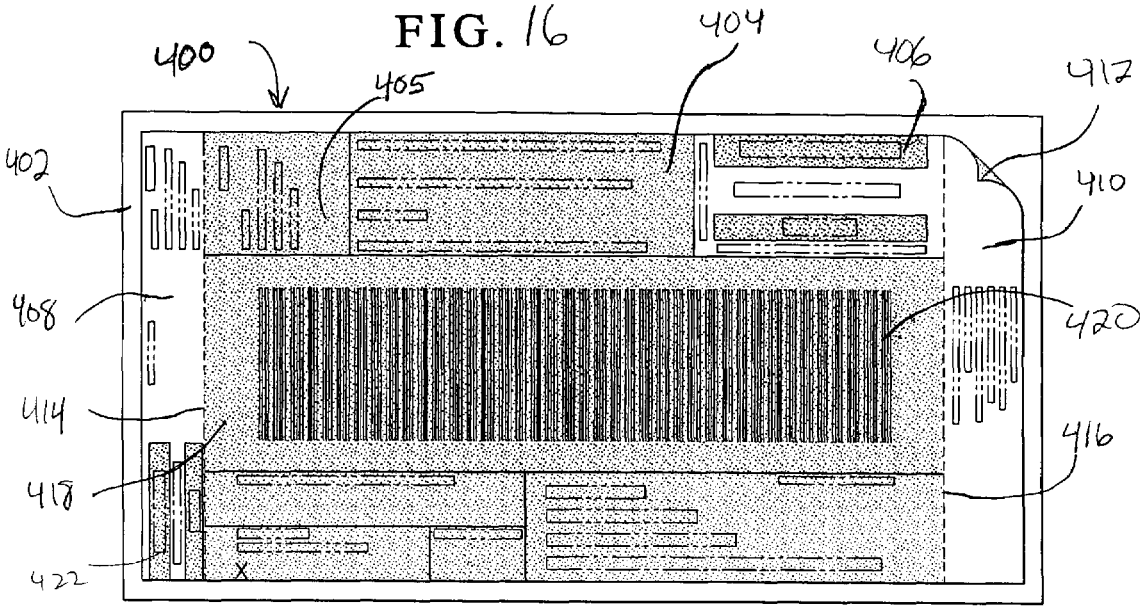
FIG. 16 illustrates a plan view of a front side of yet another embodiment of an assembly of the present invention.

Referring now to FIG. 16, an alternate embodiment of a mailing assembly 400 is illustrated. The mailing assembly 400 includes a backing sheet 402 and a form 404 removably attached to the backing sheet 402 via adhesive 412. The form 404 includes a plurality of separable parts including a return postcard 405 having a designator section 406 integrally formed as a part of and within the exterior border of the return postcard 405. The form 404 also includes anchor portions 408,410 separable from the return postcard via tear lines 414,416. The designator section 406 may be distinctly colored from a remainder of the postcard 405. For example, the color may be green to designate the generally recognized color for certified mail or may be brown to designate the generally recognized color for return receipt for merchandise mail or the like. This is particularly useful for tracking a mailpiece before, during and after delivery of the mailpiece by a special service.

The mailing assembly 400 includes the anchor portions 408,410 removably attached to the backing sheet 402 via an adhesive 412 provided under the anchor portions 408,410. The return postcard 405 is detachable from the anchor portions 408,410 via tear lines 414,416. The anchor portions 408,410 may be printed with variable information relating to the delivery by a special service including a special services designator section 422 to aid in the delivery of the mailpiece by a special service.

An area 418 may be provided within the return postcard 405 that may be printed with a machine readable code 420. The machine readable code 420 aids in the tracking of the mailpiece before, during and after delivery of the mailpiece by the special service.

In use, the mailing assembly 400 may be provided as a "blank" whereupon variable information may be printed including information relating to the special service and the machine readable code 420. The mailing assembly 400 may be provided with an area that is cut out of the backing sheet 402 (not shown). The cut-out area allows a printer to print variable information on a backside of the return postcard 405. An advantage of the cutout area is that mailing information may be provided on the backside of the return postcard 405 to aid in the delivery of the return postcard 405 following removal of the return postcard 405 from the anchor portions 408,410 following delivery of the mailpiece.

Figure 17:
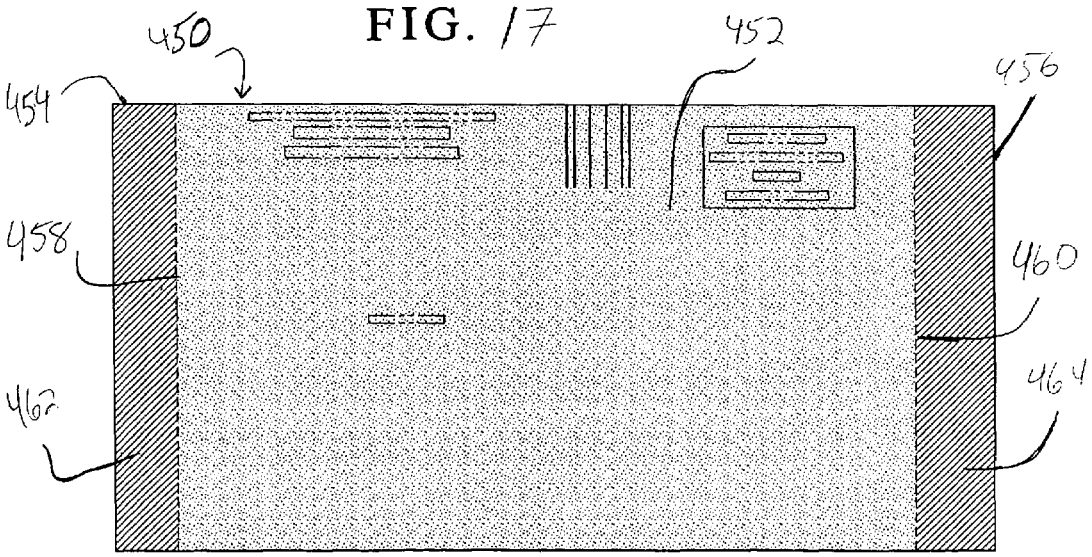
FIG. 17 illustrates a plan view of a back side of yet another embodiment of an assembly of the present invention.

Referring now to FIG. 17, a plan view of a back side of an alternate embodiment of a mailing assembly 450 is illustrated. The mailing assembly 450 includes a return postcard 452 which may include mailing information relative to delivery of the return postcard 452. Anchor portions 454,456 may be removably attached to the return postcard 452 and may be separable via tear lines 458,460. Transfer tape backing strips 462,464 may be received over and removably attached to the anchor portions 454,456 via an adhesive (not shown).

Figure 18:
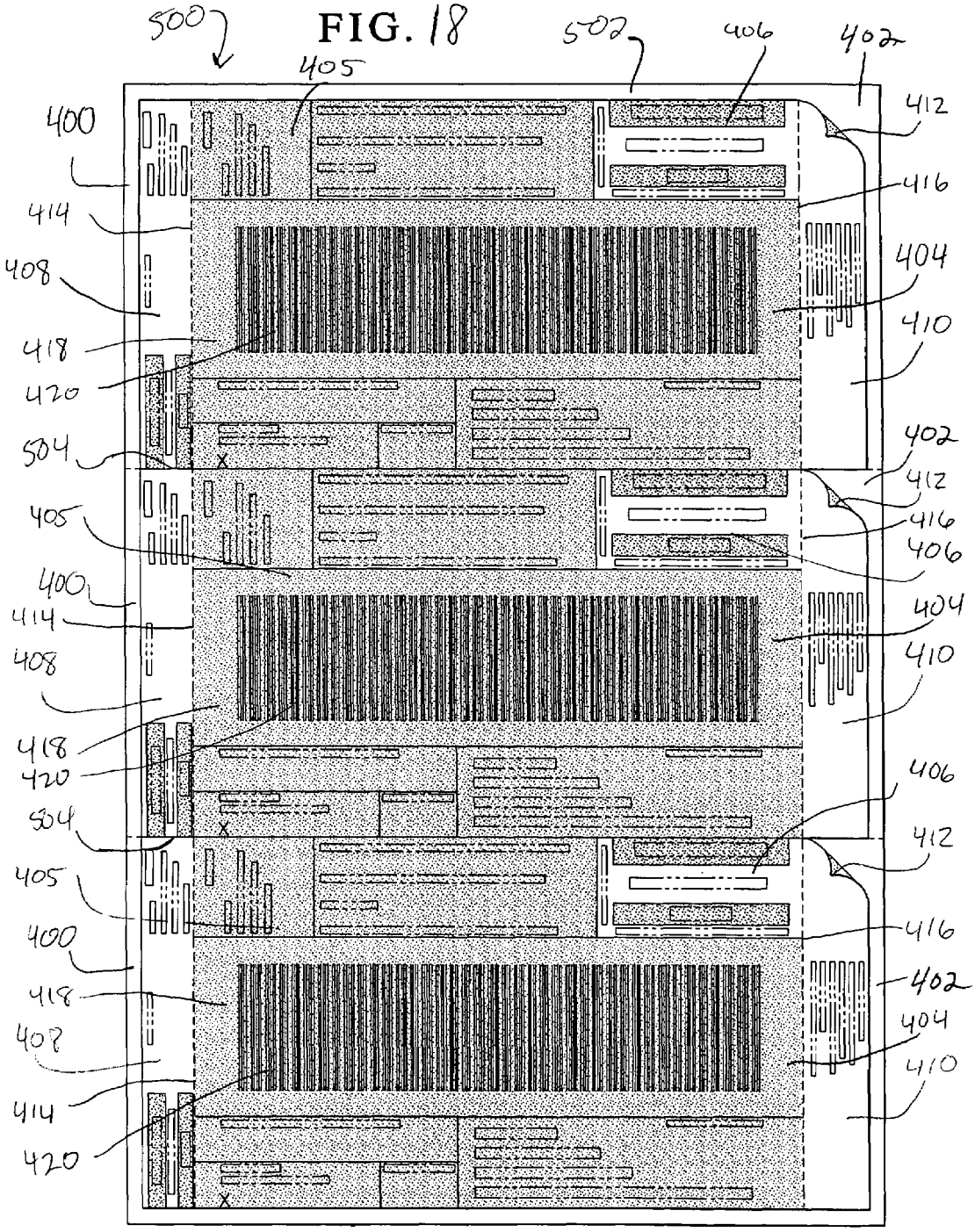
FIG. 18 illustrates a plan view of a front side of another embodiment of an assembly of the present invention in which a plurality of forms are located on a single sheet.

Referring now to FIG. 18, an alternate embodiment of a mailing assembly 500 is illustrated. The mailing assembly 500 includes a plurality of the forms 404 illustrated in FIG. 16, but provided on a single backing sheet 502. Each of the forms 404 may be separable from the adjacent form 404 by a tear line 504. In such a case, preferably, the form 404 may be a peel-and-stick assembly that is removably attached to the sheet 502. Each of the forms 404 may be separable into a return postcard 405 and anchor portions 408 and 410. Each of the return postcards 405 may include an integrally formed special service designator section 406 which may be distinctly colored from a remainder of the postcard 405 to aid in the delivery of a mailpiece by the special service.

Back sides of the anchor portions 408,410 may include the adhesive 412. The adhesive 412 does not extend under the return postcard 405. The return postcard 405 may be removably attached to the anchor portions 408,410 via tear lines 414,416. Further, the return postcard 405 may have an area 418 whereupon a machine readable code 420 may be printed.

An advantage of the present invention is that the entire mailing assembly 500 may be provided without the necessary information required for delivery of the mailpiece by a special service, that is, in effect, provided as a "blank" mailing assembly. The mailing assembly 500 may then be fed into a printing device whereupon the necessary information for delivery by the special service may be printed on one or more of the forms 404 of the entire mailing assembly 502. Thus, each of the individual form 404 may be detached from the sheet 502 as needed.

Alternatively, the tear line 504 may extend through the backing sheet 502 subdividing the backing sheet 502 into a plurality of individual backing sheets 402. Each of the forms 404 and the backing sheet 402 form the entire assembly 400 substantially as illustrated in FIG. 16. Each assembly 400 may be removable from an adjacent mailing assembly 400 via the tear line 504.

The backing sheets 402 may be provided with a plurality of areas that are cut out of the backing sheet 402 (not shown). The cut-out area allows a printer to print variable information on a back side of one or more of the return postcards 405. An advantage of the cut-out area is that mailing information may be provided on the back side of each of the return postcards 405 to aid in the delivery of the return postcard 405 following removal of the return postcard 405 from the anchor portions 414,416 of the mailpiece.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A special service mailing assembly for delivering a mailpiece requiring delivery by one of a plurality of types of special delivery services, the assembly comprising:

a backing sheet;

a first mailing form removably attached to the backing sheet by an adhesive wherein the first mailing form includes a first return postcard and a first designator section and a first receipt section contained within first exterior sides that define the first return postcard wherein the first receipt section denotes the one of the plurality of types of special delivery services and a cost for delivery by the one of the plurality of types of special delivery services and further wherein the first designator section has a first area that receives variably printed information wherein the first area denotes the one of the plurality of types of special delivery service for which the assembly is implemented wherein the first area encircles a tracking area for tracking the mailpiece and further wherein the first area has a color corresponding to one of plurality of types of special delivery services for delivery of a mailpiece wherein the color is different for each one of the plurality of types of special delivery services; and a second mailing form removably attached to the first mailing form wherein the second mailing form is removably attached to the backing sheet by the adhesive and further wherein the second mailing form includes a second receipt section having cost information, a second return postcard and a second designator section having a second area that receives variably printed information and further wherein the second designator section is indicative of the one of the plurality of types of special delivery service contained within second exterior sides that define the second return postcard.

2. The assembly of claim 1 further comprising:

a first anchor portion extending outside one of the first exterior sides of the first return postcard wherein the first anchor portion has the adhesive on a back side of the first anchor portion.

3. The assembly of claim 1 further comprising:

an area within the first designator section having a machine readable code.

4. The assembly of claim 1 wherein the first designator section is distinctly colored from a remainder of the first return postcard.

5. The assembly of claim 1 wherein the plurality of types of special delivery service includes one of certified mail, registered mail, insured mail, COD, or return receipt for merchandise mail.

6. The assembly of claim 1 further comprising:

a tear line separating the first mailing form from the second mailing form.

7. The assembly of claim 2 further comprising:

a removable label section within the first anchor portion removably attached to the first anchor portion.

8. The assembly of claim 2 wherein the first anchor portion is removably attached to the first return postcard via a tear line.

9. The assembly of claim 2 further comprising:

a third designator section contained within the first anchor portion.

10. The assembly of claim 2 further comprising:

a second anchor portion removably attached to the first return postcard outside one of the exterior sides of the first return postcard wherein a back side of the second anchor portion includes the adhesive on a back side of the second anchor portion.

11. The assembly of claim 7 further comprising:

a tear line separating the removable label section within the first anchor portion.

12. The assembly of claim 10 further comprising:

a tear line separating the second anchor portion from a remainder of the first return postcard.

13. A method for preparing a mailpiece for delivery of the mailpiece by a special delivery service, the method comprising the steps of:

providing a backing sheet;

providing a first mailing form including a first return postcard removably attached to the backing sheet wherein the first return postcard is integrally formed with a first special service designation section and a first receipt section wherein the first receipt section denotes the special delivery service and a cost for delivery by the special delivery service and further wherein the first special service designation section has a first area for receiving instructions regarding the delivery and for denoting the special delivery service wherein the first area encircles an identifying number of the mailpiece and further wherein the first special designation section is completely within exterior sides that define the first return postcard;

providing a second area within the first return postcard wherein variable information is printed;

providing a second mailing form including a second return postcard removably attached to the backing sheet wherein the second return postcard is integrally formed with a second receipt section and a second special designation section wherein the second special designation section is completely within exterior sides that define the second return postcard and further wherein the second receipt section denotes the special delivery service and a cost for delivery by the special delivery service;

printing information relating to the special delivery service on first area within the second return postcard;

removing the first mailing form from the backing sheet; and attaching the first mailing form to the mailpiece to effect delivery of the mailpiece by the special delivery service.

14. The method of claim 13 further comprising the step of:

providing an anchor portion adjacent to the first return postcard.

15. The method of claim 14 further comprising the steps of:

providing a removable label section as a portion of the anchor portion; and removing the removable label section from the anchor portion.

16. A mailing assembly for preparing a mailpiece for delivery by a special service, the assembly comprising:

a first mailing form having a first receipt section and a first return postcard and a first anchor portion removably attached to the first return postcard wherein the first receipt section denotes the special service and a cost for delivery by the special service and further wherein the first anchor portion has an adhesive on a backside of the first anchor portion and further wherein the first return postcard has no adhesive;

a first backing strip received over the adhesive on the backside of the first anchor portion;

a second mailing form having a second receipt section and a second return postcard and a second anchor portion removably attached to the second return postcard wherein the second receipt section denotes the special service and a cost for delivery by the special service and further wherein the second anchor portion has the adhesive on a backside of the second anchor portion and further wherein the second return postcard has no adhesive;

a second backing strip received over the adhesive on the backside of the second anchor portion; and a first designator section indicative of a type of special mail delivery service wherein the first designator section is contained within exterior sides of the first return postcard wherein the first designator section is printed with variable information that identifies the type of the special mail delivery service as one of registered mail, certified mail, COD, insured mail and return receipt for merchandise and further wherein instructions regarding the delivery of the mailpiece are juxtaposed with the first designator section.

17. The assembly of claim 16 further comprising:

a tear line arranged for separating the first return postcard from the first anchor portion.

18. The assembly of claim 16 further comprising:

a tear line arranged for separating the first mailing form from the second mailing form.

19. The assembly of claim 16 further comprising:

a tear line arranged for separating the second anchor portion from the second return postcard.

20. The assembly of claim 16 further comprising:

an area contained within the first return postcard variably printed with a machine readable code.

* * * * *